US010864656B2

(12) United States Patent
Tolzman et al.

(10) Patent No.: US 10,864,656 B2
(45) Date of Patent: Dec. 15, 2020

(54) SLAB CUTTING APPARATUS AND METHOD

(71) Applicant: Cambria Company LLC, Eden Prairie, MN (US)

(72) Inventors: Craig Tolzman, St. Peter, MN (US); Brian R. Scoggin, Prior Lake, MN (US)

(73) Assignee: Cambria Company LLC, Eden Prairie, MN (US)

( * ) Notice: Subject to any disclaimer, the term of this patent is extended or adjusted under 35 U.S.C. 154(b) by 459 days.

(21) Appl. No.: 15/411,843

(22) Filed: Jan. 20, 2017

(65) Prior Publication Data

US 2018/0207838 A1 Jul. 26, 2018

(51) Int. Cl.

| | |
|---|---|
| ***B24B 7/22*** | (2006.01) |
| ***B24B 9/00*** | (2006.01) |
| ***B28D 1/04*** | (2006.01) |
| ***B28D 1/00*** | (2006.01) |
| ***B28D 7/00*** | (2006.01) |

(52) U.S. Cl.

CPC ..... *B28D 1/044* (2013.01); *B24B 7/22* (2013.01); *B24B 9/00* (2013.01); *B28D 1/003* (2013.01); *B28D 1/04* (2013.01); *B28D 7/005* (2013.01)

(58) Field of Classification Search

CPC .. B24B 7/22; B24B 9/00; B28D 1/003; B28D 1/044; B28D 7/005

USPC ..... 451/41, 57, 65

See application file for complete search history.

(56) References Cited

U.S. PATENT DOCUMENTS

| | | | | | |
|---|---|---|---|---|---|
| 1,554,456 | A | | 9/1925 | Morrill | |
| 2,052,031 | A | | 8/1936 | Merrigan | |
| 2,454,992 | A | * | 11/1948 | Coleman | B27B 5/08 144/24.05 |
| 2,838,041 | A | | 6/1958 | Rovis | |
| 3,224,022 | A | * | 12/1965 | Kehr | B23D 79/00 15/4 |
| 3,550,575 | A | * | 12/1970 | Metzger | B24B 7/12 125/3 |
| 3,828,758 | A | * | 8/1974 | Cary | B24B 27/00 125/13.01 |
| 3,885,352 | A | * | 5/1975 | Juranitch | B24B 3/52 451/65 |
| 4,418,499 | A | * | 12/1983 | Shirai | B24B 49/16 451/14 |
| 4,660,539 | A | | 4/1987 | Battaglia | |

(Continued)

FOREIGN PATENT DOCUMENTS

| | | |
|---|---|---|
| EP | 0537674 | 8/1997 |
| EP | 2404700 | 1/2012 |

(Continued)

OTHER PUBLICATIONS

Farnese Australia, "Ezy Flat" Copyright 2010, http://www.farnese.com.au/ezyflat.html.

(Continued)

*Primary Examiner* — Eileen P Morgan

(74) *Attorney, Agent, or Firm* — Fish & Richardson P.C.

(57) ABSTRACT

Systems and methods are described for finishing slabs. In an exemplary embodiment, a stone-cutting miter saw includes a support fixture that is configured to support a stone slab, a guide rail, and cutting and grinding heads movably supported on the guide rail.

20 Claims, 8 Drawing Sheets

(56) References Cited

U.S. PATENT DOCUMENTS 4,685,180 A * 8/1987 Kitaya ..... B24B 9/10 29/33 R
4,698,088 A * 10/1987 Bando ..... C03B 33/037 65/174
5,056,272 A * 10/1991 Battaglia ..... B24B 7/06 125/13.01
5,396,736 A * 3/1995 Bando ..... C03B 33/03 451/5
5,494,548 A 2/1996 Baca
5,605,141 A 2/1997 Bilotta
6,006,735 A * 12/1999 Schlough ..... B24B 9/06 125/13.01
6,276,355 B1 * 8/2001 Zhang ..... B28D 5/024 125/13.01
6,941,939 B2 * 9/2005 Pedrini ..... B23D 47/04 125/12
7,198,042 B2 4/2007 Harris
7,373,936 B1 * 5/2008 Zagorouiko ..... B23Q 9/005 125/38
7,748,373 B2 * 7/2010 Toncelli ..... B28D 1/043 125/35
7,771,249 B2 * 8/2010 Schlough ..... B28D 1/046 451/5
7,909,028 B2 * 3/2011 Spurgeon ..... B44C 1/26 125/13.01
9,010,310 B2 * 4/2015 Bockes ..... E01C 23/0933 125/12
9,886,019 B2 * 2/2018 Toncelli ..... G05B 19/18
2008/0085659 A1 * 4/2008 Stratti ..... E21C 31/02 451/26
2009/0145415 A1 6/2009 Spurgeon
2010/0304645 A1 * 12/2010 Gariglio ..... B24B 9/102 451/44
2011/0041827 A1 * 2/2011 Boyko ..... B28B 11/12 125/12
2013/0047390 A1 * 2/2013 Ongaro ..... B23O 39/026 29/27 C
2014/0331838 A1 * 11/2014 Baker ..... B26D 7/12 83/174
2015/0165581 A1 * 6/2015 Nagata ..... B23F 21/04 451/37

FOREIGN PATENT DOCUMENTS

JP 06023739 A * 2/1994 ..... B28D 1/04
JP 06023739 A * 2/1994 ..... B28D 1/04

OTHER PUBLICATIONS

Farnese Australia, "MITRE Saw Exel" Copyright 2010, http://www.farnese.com.au/mitre-saw.html.
Achilli Evolution in Stone Technology, "Miter Saw MSA" Copyright 2014, http://www.achilli.com/stone-machinery/monoblock-miter-saw-msa/.
Omega Diamond, "Blue Ripper Miter Master Rail Saw" Copyright 2011-2013, http://omegadiamond.com/601-684.
Breton, "Modulo 3—Edge Polisher Bellani" Publicly available by Mar. 16, 2016, http://www.breton.it/granite/en/product/Perimeter_finishing/Modulo_3; http://web.archive.org/web/20150316072743/http://www.breton.it/gmnite/en/product/Perimeter_finishing/Modulo_3.

* cited by examiner

SLAB CUTTING APPARATUS AND METHOD

TECHNICAL FIELD

This document describes systems and processes for fabricating slab products, for example, cutting and finishing stone slab products.

BACKGROUND

Power saws or chop saws are often used to make accurate cuts in a work piece, such as slabs comprising stone material (e.g., marble, granite, manufactured quartz) or wood material. Power saws can be used to make crosscuts, miter cuts, bevel cuts, or compound cuts. Various configurations have been proposed to provide particular cutting techniques and finishes.

Conventional chop saws often pivot from a single point with the blade cutting into the work piece. Such saws have been used to cut miters across the width of a work piece by angling the saw blade relative to the work piece. Sliding compound-miter saws have been proposed that cut a work piece using a blade and a motor assembly that slides along a work piece. The sliding saw can cut wider work pieces than fixed-head saws by sliding along the length of the work piece to complete cut.

SUMMARY

Some embodiments described herein include systems and methods for shaping/finishing one or more slabs, such as stone slabs suitable for use in living or working spaces (e.g., along a countertop, table, floor, or the like). In some exemplary embodiments, an improved cutting apparatus is provided that includes a support fixture that supports a slab along a support plane in a longitudinal direction. The improved cutting apparatus can include a miter saw assembly comprising both a cutting head and a grinding head that are contemporaneously movable in a longitudinal path along a length of the slab to produce a smooth cut edge, for example, having an angled orientation transverse to a major surface of the slab for achieving a miter joint.

Some embodiments described herein provide a miter saw having a set of features that enable an operator to reduce the likelihood of cutting imperfections, chips, roughened edges, or a combination thereof that might otherwise result from relative movement of a cutting blade along the rigid slab material, from variations in thickness through the slab material to be cut, or from a varying height of the table surface where cutting is performed. For example, the miter saw may be equipped with a cutting head having a cutting blade to provide an initial cut of a stone slab, and a grinding head positioned longitudinally spaced apart from the cutting head and having a grinding blade to smooth and finish the cut surface. Alternatively or additionally, a support fixture of the miter saw may include pneumatic clamps for securing the material to ensure that the surface of the material to be cut remains fixed during the cutting operation.

In some exemplary cutting operations described herein, the material to be cut is initially placed and secured on to the table of the support fixture. A carriage that includes the cutting head and the grinding head is moved contemporaneously with the cutting head in a longitudinal direction along the stone slab to be cut. During relative movement of the carriage along a length of the stone slab, the cutting head cuts the stone slab, for example, to provide a cut edge of the stone slab oriented at an angle transverse to a major surface of the slab (e.g., for producing a miter joint edge). Also during relative movement of the carriage along a length of the stone slab, the grinding head grinds, polishes and/or otherwise finishes the edge of the slab that has been cut by the cutting head. In some exemplary embodiments, the cutting and grinding heads can operate in an array, on a common cutting surface of the stone slab (e.g., in series), without repositioning of the stone slab and/or without reconfiguration of other components of the miter saw, thereby reducing the amount of manual intervention required to successfully cut the stone slab and finish the cut surface of the stone slab with a substantially smooth edge free of significant chips or other imperfections.

Some embodiments described herein provide a stone-cutting miter saw including a support fixture configured to support a stone slab along a support plane extending in a longitudinal direction, a guide rail extending in the longitudinal direction, and a cutting head and a grinding head that are both movably supported on the guide rail. The cutting head includes a stone cutting blade that is rotatable about a cutting blade axis of rotation, and the grinding head includes a stone grinding blade configured to grind a surface of the stone slab cut by the cutting head and that is rotatable about a grinding blade axis of rotation spaced apart in the longitudinal direction from the cutting blade axis of rotation.

Some embodiments described herein may optionally provide one or more of the following features. The stone cutting blade (and, optionally, the grinding blade) may be adjusted and locked in a position relative to the support plane at a cut surface angle of about 15° to about 80°, and about a 22.5° or a 45° angle in particular implementations. The cutting blade axis of rotation may be parallel to the grinding blade axis of rotation. The cutting blade may include a radial cutting surface. The grinding blade may include an axial grinding surface. The cutting head and grinding head may be supported on the guide rail by a carriage, and the cutting head may be positioned a fixed distance from the grinding head while the carriage moves along the guide rail. The cutting blade and the grinding blade may be configured to rotate at identical speeds while the carriage moves along the guide rail. The cutting head may be supported on the guide rail by a first carriage and the grinding head may be supported on the guide rail by a second carriage, and the first carriage and the second carriage may be configured to independently move on the guide rail.

Some exemplary embodiments of the apparatus described herein comprise a support fixture configured to support a stone slab along a support plane extending in a longitudinal direction, a clamping fixture configured to secure the stone slab to the support fixture, a guide rail extending in the longitudinal direction, and a cutting head and a grinding head that are both movably supported on the guide rail. The cutting head includes a stone cutting blade that is rotatable about a cutting blade axis of rotation and capable of being positioned at about a 45° angle relative to the support plane. The grinding head includes a stone grinding blade configured to grind a surface of the stone slab cut by the cutting head and that is rotatable about a grinding blade axis spaced apart in the longitudinal direction from the cutting blade axis. The stone cutting saw may further include a programmable logic controller (PLC) configured to control rotation of the cutting head and the grinding head, and configured to control movement of the cutting head and grinding head along the guide rail.

Some embodiments described herein may include one or more of the following features. The cutting blade axis of rotation can be parallel to the grinding blade axis of rotation.

The cutting blade may include a radial cutting surface. The grinding blade may include an axial grinding surface. The cutting head and grinding head may be supported on the guide rail by a carriage, and the cutting head may be positioned a fixed distance from the grinding head. The cutting blade and the grinding blade may be configured to rotate at identical speeds while the carriage moves along the guide rail. The cutting head may be supported on the guide rail by a first carriage, the grinding head may be supported on the guide rail by a second carriage, and the first carriage and the second carriage may be configured to independently move along the longitudinal direction on the guide rail.

Some exemplary embodiments described herein provide a method for cutting and grinding a stone slab using a stone-cutting miter saw, including securing the stone slab to a support fixture and advancing a cutting blade and a grinding blade in series along a length of the stone slab while the cutting blade and grinding blade rotate to cut and grind an edge of the stone slab.

Implementations may include some, all, or none of the following features. During the advancing step, the cutting blade may rotate about a cutting blade axis of rotation and the grinding blade may rotate about a grinding blade axis of rotation, and the cutting blade axis of rotation may be maintained in a fixed position relative to the grinding blade axis or rotation. During the advancing step, the cutting blade axis of rotation may be parallel to the grinding blade axis of rotation. The method may further include positioning the cutting blade at a first angle relative to a major surface of the stone slab, and positioning the grinding blade at a second angle relative to the major surface of the stone slab. The first and second angles may be identical.

Optionally, the systems and techniques described herein may provide one or more of the following advantages. First, some embodiments described herein include a system that enables finer cuts along the surface of the stone slab. A grinding head that follows a cutting head can grind, polish, and/or otherwise finish the initial cut produced by the cutting head. The finished surface may thus have a clean edge with reduced roughness or serrations.

Second, some embodiments described herein include a system that facilitates an automated or semi-automated cutting and grinding operation. An edge and/or surface of a stone slab may be cut and/or finished with reduced manual intervention. The cutting head and grinding head can operate together (e.g., in series) on a common surface of the stone slab without repositioning of the stone slab and/or without reconfiguration of the system.

Third, some embodiments described herein facilitate assembly of countertops, work surfaces, wall coverings, etc., using cut stone slabs. In various exemplary embodiments described herein, a stone slab cut by a cutting head and finished with a grinding wheel may provide a smooth edge that facilitates assembly while reducing additional processing steps during assembly and installation that may otherwise be required to assemble the stone slab with a complementary stone slab.

Fourth, some embodiments described herein facilitate a finished countertop, work surface, wall covering, etc., having a desirable aesthetic appearance. A smooth cut edge of a stone slab or portion of a stone slab facilitates a finished stone slab or portion of a stone slab assembly having a reduced visible appearance of seams between portions of stone slabs or portions of stone slabs. For example, a cut and finished stone slab or portion of a stone slab as described herein may promote the appearance of a stone slab or portion of a stone slab that is free from seams, and/or a stone slab or portion of a stone slab that is larger, thicker, etc., when assembled with another stone slab or portion of a stone slab (e.g. assembled by a miter joint).

The details of one or more embodiments are set forth in the accompanying drawings and the description below. Other potential features and advantages will become apparent from the description, the drawings, and the claims.

DESCRIPTION OF THE DRAWINGS

In the drawings, like reference numbers represent like parts throughout.

DETAILED DESCRIPTION OF ILLUSTRATIVE EMBODIMENTS

Figures 1A, 1B:
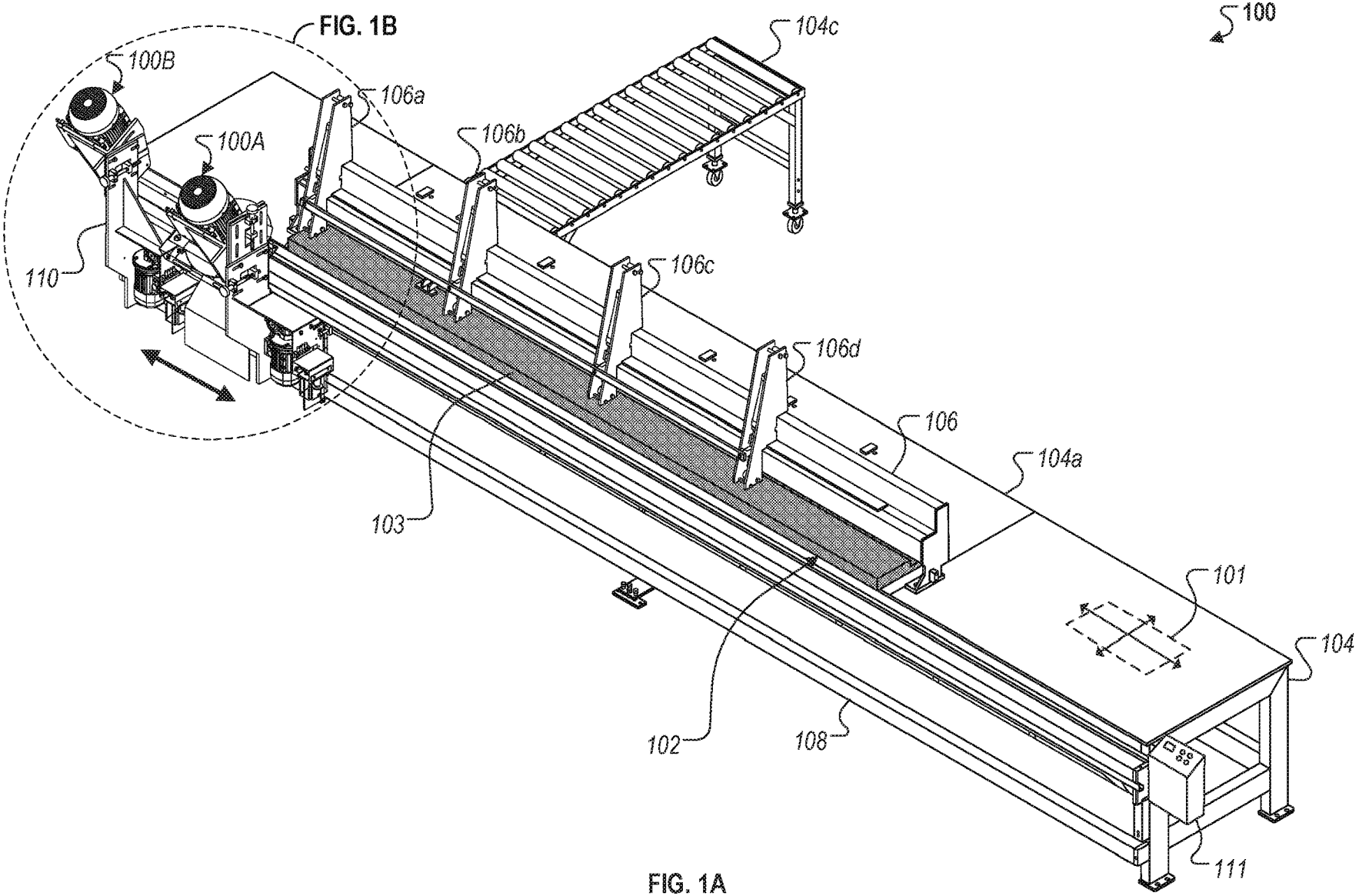
FIG. 1A is a perspective view of a slab cutting apparatus.
FIG. 1B is a perspective view of the apparatus illustrated in FIG. 1A including a cutting head and a grinding head.
Figure 1B:
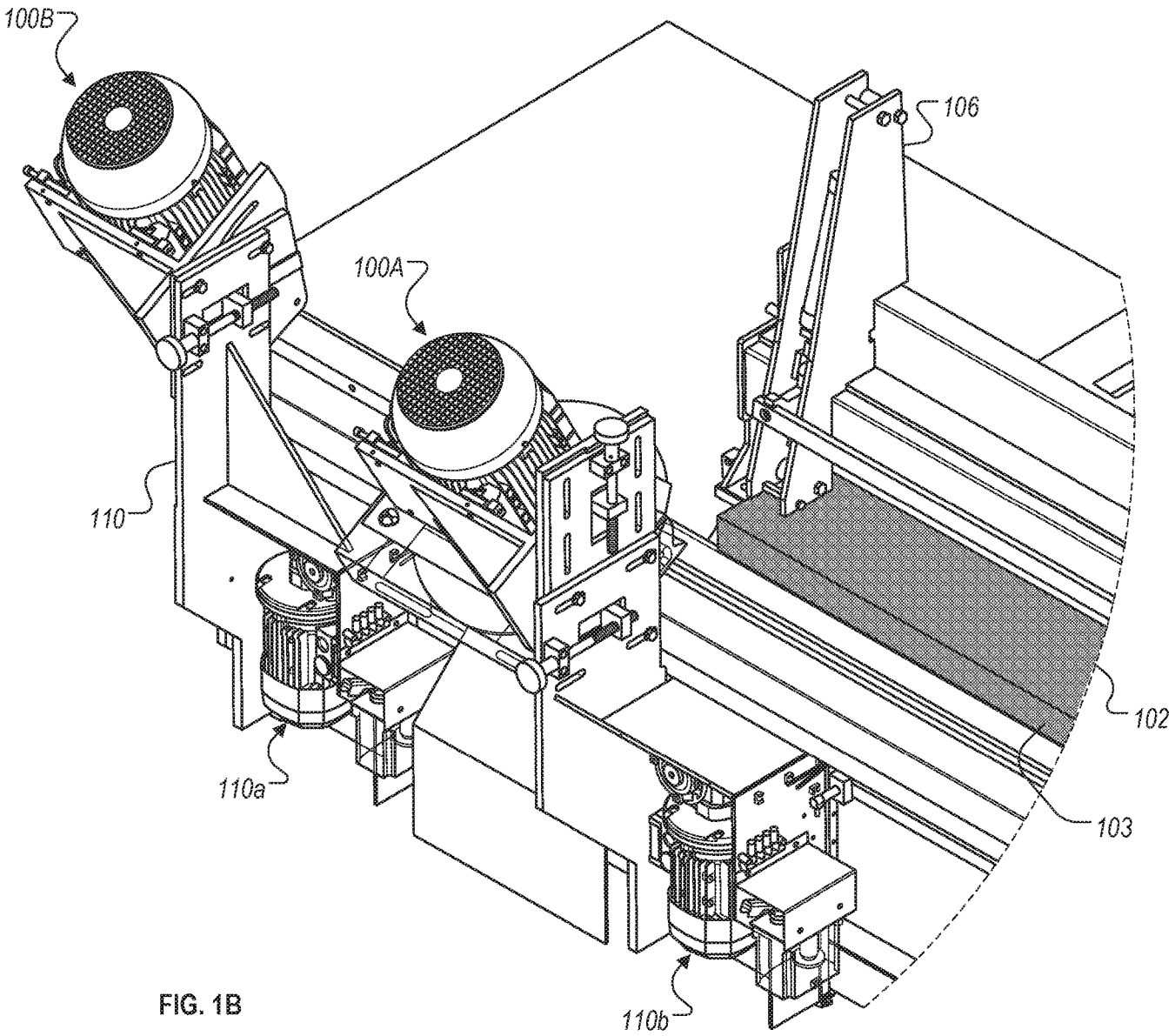

Referring to FIG. 1A, a perspective view of a slab cutting apparatus 100 is shown, including a cutting head 100A, grinding head 100B, support structure 104, and clamping structure 106. The slab cutting apparatus 100 in this example is configured as a miter saw for cutting an edge 103 of a slab 102, such as a stone slab (e.g., a slab or portion of a slab such as a granite slab, a marble slab, a manufactured slab comprising predominately quartz particulate material, or the like). For example, miter saw 100 may be used to produce a miter cut along a length of slab 102 in a cut plane oriented at about 30° to about 60° relative to a major surface of the slab 102, and preferably at about a 45° angle relative to a major surface of the slab 102 in particular implementations. The cutting head 100A and grinding head 100B contemporaneously operate on the edge 103 of the slab 102 (e.g. at the same time in a single pass) to produce a finished cut having smooth edges suitable for subsequent seaming or other assembly operations of the slab 102.

In an exemplary embodiment, support structure 104 provides one or more support surfaces on which the slab 102 is retained. For example, support structure 104 includes a rubber-topped table on which a slab 102 may be placed prior to a cutting operation. The rubber-topped table may reduce vibrations (e.g. during cutting and grinding operations) while providing a protective surface that reduces the likelihood of damage to the surface of the slab 102 during operation of the miter saw 100.

Clamping structure 106 includes one or more clamps that secure the slab 102 in a user-selected position relative to support structure 104. In an exemplary embodiment, clamping structure includes one or more pneumatic clamps, such as pneumatic claims 106*a-d*, attached to the support structure 104. When engaged, the pneumatic clamps exert a clamping force to clamp the slab 102 to the support structure 104 in a fixed position. The four pneumatic clamps 106*a-d* may be lowered onto a top surface 102*a* of the slab 102 opposite to a bottom surface of the slab 102 in contact with the support structure 104 to secure the slab 102 during operation of miter saw 100. The clamping structure 106 and rubber-topped table of support structure 104 may have complementary characteristics that facilitate secure clamping of slab 102. For example, engagement of the pneumatic clamps 106*a-d* may cause the rubber of the rubber-topped table to at least partially compress. In other exemplary embodiments, the support structure may have a rigid, incompressible surface that is not compressed by the weight of the slab 102 and/or a force of the pneumatic claims 106*a-d*. The pneumatic clamps 106*a-d* may be engaged by an electronic actuating means by a controller 111 of miter saw 100. Alternatively, or additionally, the pneumatic clamps 106*a-d* may be lowered onto the top surface 102*a* of the slab 102 manually (e.g. by the manual operation of a lever).

The top surface 104*a* of the support structure 104 (e.g. the rubber topped surface that the slab 102 may be supported on) defines a support plane 101. When the slab 102 is supported by the support structure 104 in position for cutting, major faces of the slab 102 are parallel with support plane 101, and/or the bottom surface of slab 102 supported on top surface 104*a* is coplanar with the support plane 101. In an exemplary embodiment, the support plane 101 is substantially horizontal such that the slab 102 is arranged substantially horizontally during operation of miter saw 100 (e.g., top and bottom major faces of the slab 102 are arranged substantially horizontally).

The support structure 104 may include an extension table 104*c* configured to support a slab that extends beyond the surface area of the rubber-topped table of the support structure 104. Support structure 104 may include one or more extension tables 104*c*, carts, or other support structures, that facilitate positioning and support of the slab 102 with miter saw 100, and may be removably connected with other portions of support structure 104.

Miter saw 100 includes a guide rail 108 extending longitudinally along support structure 104. Guide rail 108 may support cutting head 100A and/or grinding head 100B, and provide a track that cutting head 100A and/or grinding head 100B may travel along during operation. In an exemplary embodiment, the guide rail 108 is arranged parallel (e.g., substantially parallel within 5°) of the support plane 101. The cutting head 100A and/or grinding head 100B can thus move along the slab 102 while maintaining a consistent height relative to the slab 102 and the support plane 101 along an entire length of the support structure 104.

The cutting head 100A and grinding head 100B of miter saw 100 may be configured to simultaneously operate on the same surface of a single slab (e.g., cutting the edge 103 of the stone slab 102) during a combined cutting and grinding operation. For example, a cutting blade 114*a* (FIG. 3A) of the cutting head 100A and a grinding blade 114*b* (FIG. 2C) of the grinding head 100B may simultaneously operate on the same surface of the slab 102 such that both the cutting blade 114*a* and grinding blade 114*b* rotate and contact the same surface of the slab 102 while the carriage 110 moves in the longitudinal direction along the guide rail 108. In an exemplary embodiment, the carriage 110 moves from an initial position at a first end of the support structure 104 (e.g. left end of the support structure 104, as viewed in FIG. 1A) to a second end of the support structure (e.g. the opposite, right end of the support structure 104, as viewed in FIG. 1A) along guide rail 108. The cutting head 100A and grinding head 100B are arranged such that the cutting blade 114*a* of the cutting head 100A contacts the slab 102 to produce an initial cut of the slab 102. The grinding head 100B is configured to follow the cutting head 100A such that the grinding blade 114*b* contacts the cut surface of the slab 102 cut by the cutting blade 114*a* to produce a smooth edge having reduced roughness or serrations.

Movement of the carriage 110 from an initial position at the first end of the support structure 104 to a final position at the second end of the support structure 104 facilitates operation of both the cutting blade 114*a* and grinding blade 114*b* on the edge 103 of the slab 102. In an exemplary embodiment, the cutting head 100A and the grinding head 100B operate in series on the same edge of the slab 102. For example, as cutting head 100A and grinding head 100B move along the length of the slab 102 (e.g. carried by carriage 110 moving along guide rail 108), cutting head 100A initially cuts the slab 102. The grinding head 100B follows the cutting head 100A (e.g. at a fixed distance behind cutting head 100A) to finish the edge of slab 102 cut by cutting head 100A. Accordingly, both the cutting head 100A and grinding head 100B may operate simultaneously on a common edge 103 of the slab 102, and miter saw 100 may produce a finished, smooth miter cut of the slab 102 by making a single pass of carriage 110 along the length of the slab 102.

Miter saw 100 includes a controller 111 that is configured to control various operations of the miter saw 100. For example, the controller 111 may be a programmable logic controller (PLC), programmable automation controller, computer system, combinations thereof, or other controller configured to control various operations of the miter saw 100. The controller 111 can control, for example, the positioning of the cutting head 100A and/or the grinding head 100B along the guide rail 108, the orientation of the cutting head 100A and/or the grinding head 100B relative to the support plane 101, the rotation of the cutting and grinding blades (e.g., in revolutions per minute (RPM), the orientation of the cutting and grinding blades, positioning and engagement of the pneumatic clamps 106*a-d* onto a surface of the slab 102, and/or operation of fluid nozzles (e.g. to dispense cooling and/or flushing fluid proximate cutting head 100A and/or grinding head 100B). Controller 111 may thus facilitate an automated or semi-automated cutting and grinding operation that facilitates efficient production of slabs having a miter cut with a smooth cut edge.

Referring to FIG. 1B, a perspective view of the carriage 110 of the miter saw 100 is shown. In an exemplary embodiment, the carriage 110 carries the cutting head 100A and the grinding head 100B. The carriage 110 is movable in a longitudinal direction along the guide rail 108 to cut the slab 102 during operation of miter saw 100. In some embodiments, motors 110*a* and 110*b* are used to drive the cutting head 100A and the grinding head 100B, respectively, along the guide rail 108. For example, the motors 110*a* and 110*b* can be electric trolley motors. In other exemplary embodiments, a single motor can be used to drive both the cutting head 100A and the grinding head 100B along the guide rail 108. For example, a motor, such an electric trolley motor, can be used to move a single carriage that holds both the cutting head 100A and the grinding head 100B. Alternatively, or in addition, the cutting head 100A and/or the grinding head 110B can be moved manually by an operator along the guide rail 108.

In an exemplary embodiment, the cutting head 100A and the grinding head 100B are supported by the carriage 110 in fixed axial positions relative to one another such that a spacing between the cutting head 100A and the grinding head 100B (e.g., the offset spacing between the cutting blade axis of rotation (A) and the grinding blade the axis of rotation (B) (FIGS. 4A-4B)) remains consistent as the carriage 110 moves along the guide rail 108. Movement of the cutting head 100A along the guide rail 108 thus results in corresponding movement of the grinding head 100B such that the cutting head 100A and grinding head 100B contemporaneously move along the slab 102 at an identical translational speed (even if the respective rotational speeds are different or the same). Fixed relative positioning of the cutting head 100A and the grinding head 100B may, in some optional embodiments, simplify the control of the saw 100 by allowing movement of the cutting head 100A and grinding head 100B to be controlled together (e.g. rather than movement and the position of the cutting head 100A and grinding head 100B being independent and requiring independent control). Thus, during a cutting and grinding operation, the slab 102 can be cut and finished with a single movement of the carriage 110 along the guide rail 108, such as by making a single pass from the first end of the support structure 104 to the second end of the support structure 104 along the slab 102. Exemplary miter saw 100 may thus reduce the number of operations required to produce a miter cut slab 102, while improving the quality of the cut surface.

Alternatively or additionally, carriage 110 may include first and second carriages that carry the cutting head 100A and the grinding head 100B, respectively. The first and second carriages may not be permanently fixed to each other such that the first carriage carrying cutting head 100A may move along a length of the support structure 104 independently of the second carriage carrying grinding head 100B. A distance between the cutting head 100A and the grinding head 100B may thus be variable during operation of miter saw 100. In an exemplary embodiment, first and second carriages movable relative to each other may facilitate movement of cutting head 100A at a first speed along the slab 102 and movement of grinding head 100B at a second speed along the slab 102 that is different than the first speed. For example, cutting head 100A may move relatively slowly as it operates to cut the slab 102. Grinding head 100B may begin operating on the cut surface of slab 102 after cutting head 100A has completed or nearly completed the cut, and may move relatively faster along slab 102. Accordingly, a distance between cutting head 100A and grinding head 100B may vary as the saw 100 operates to cut and finish the slab 102 (e.g. a distance between cutting head 100A and grinding head 100B may be reduced due to the faster moving grinding head catching up to the slower moving cutting head 100A) as the cutting head 100A and grinding head 100B complete a single pass along slab 102. Similarly, cutting head 100A may move relatively faster as it operates to cut the slab 102. Grinding head 100B may begin operating on the cut surface of slab 102 after cutting head 100A has initiated a cut, and may move relatively slower along slab 102. Accordingly, a distance between cutting head 100A and grinding head 100B may vary as the saw 100 operates to cut and finish the slab 102 (e.g. a distance between cutting head 100A and grinding head 100B may increase due to the slower moving grinding head falling behind the faster moving cutting head 100A) as the cutting head 100A and grinding head 100B complete a single pass along slab 102.

Figure 4A:
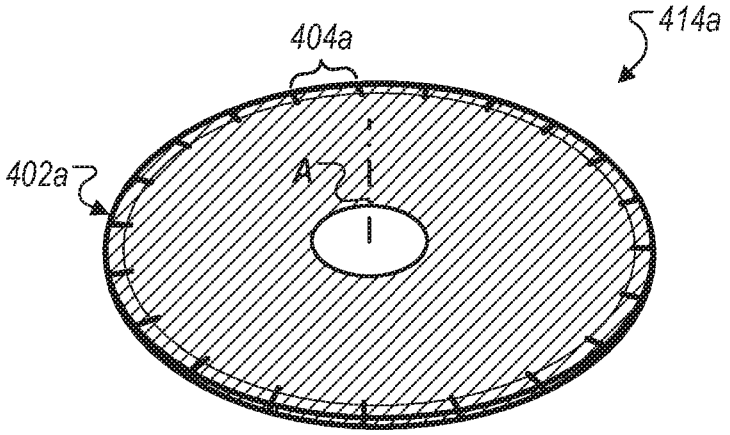
FIG. 4A is a perspective view of an exemplary cutting blade.

The cutting head 100A includes a cutting blade 114*a*, such as a stone cutting blade, having a size configured to cut through an entire thickness of the slab 102. For example, cutting head 100A may include a cutting blade 114*a* coated with diamond particles on at least an outer edge of cutting blade 114*a* (e.g. the outer edge defining a thickness of the cutting blade 114*a*), and may be characterized as having a radial cutting surfaces. The diameter of the cutting blade 114*a* may be selected so that the cutting blade is sufficiently large to cut through the thickness of slab 102. Alternatively or additionally, the cutting blade 114*a* may have a segmented-type edge including a plurality of segments 404*a* (FIG. 4A).

The grinding head 100B includes components configured to grind, polish, and/or otherwise finish a surface of the slab 102 initially cut by the cutting blade 114*a* of the cutting head 100A. For example, the grinding head 100B includes a grinding blade 114*b* (FIG. 2C). The grinding blade 114*b* can be made from a steel or metallic disc with abrasive particles, such as diamond particles, bonded to the surface. Alternatively or additionally, the grinding blade 114*b* may have a segmented-type edge such that the perimeter of the grinding blade 114*b* includes a plurality of segments. In an exemplary embodiment, each segment may extend perpendicularly (e.g. substantially perpendicularly between 80° and 100°) relative to a major face of the grinding blade 114*b* such that the segments extend parallel (e.g. substantially parallel within 10°) with an axis of rotation (B) of the grinding blade 114*b* (FIG. 46). Accordingly, the grinding blade 114*b* may be described as having axial grinding surfaces, and/or may be substantially identical to the cutting blade 114*a* except for having segments that are bent relative to a major face of the grinding blade 114*b*.

In some exemplary embodiments, the grinding blade 114*b* may be a grinding wheel that is at least partially composed of an abrasive compound. For example, the grinding wheel can be made from a composite material consisting of coarse-particular aggregate pressed and bonded together by a cementing matrix to form a solid, circular shape.

In various exemplary embodiments, the miter saw 100, and cutting blade 114*a* and grinding blade 114*b*, are configured to cut and finish a slab made from a particular material. For example, miter saw 100 may be configured to cut and finish various slab materials, including quarried stone slabs, such as quarried granite and marble slabs, manufactured stone slabs, such as synthetic molded stone slabs made from quartz, granite, other stone material, cement, metal, and wood.

The cutting head 100A and the grinding head 100B each include a motor for spinning the cutting blade 114*a* and the grinding blade 114*b* during cutting and grinding operations. For example, the motors may be electric motors controllable to deliver a desired RPM to cutting head 100A and grinding head 100B. In various exemplary embodiments, the cutting head 100A and/or the grinding head 100B may be pneumatic, hydraulic, or otherwise powered to achieve a desired RPM of the cutting and grinding blades 114*a* and 114*b*.

Figure 2A:
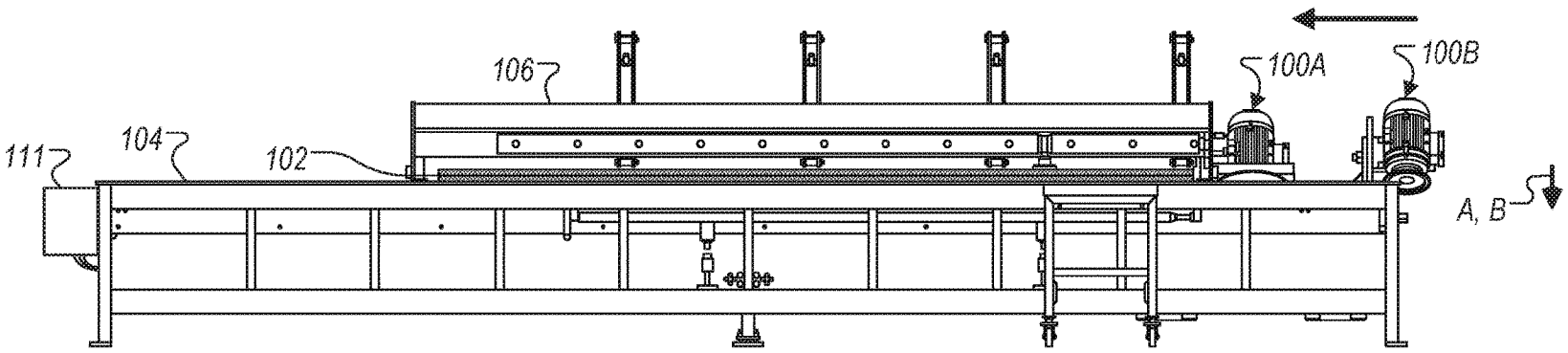
FIGS. 2A-2C are side views of the apparatus illustrated in FIG. 1A.
Figure 2B:
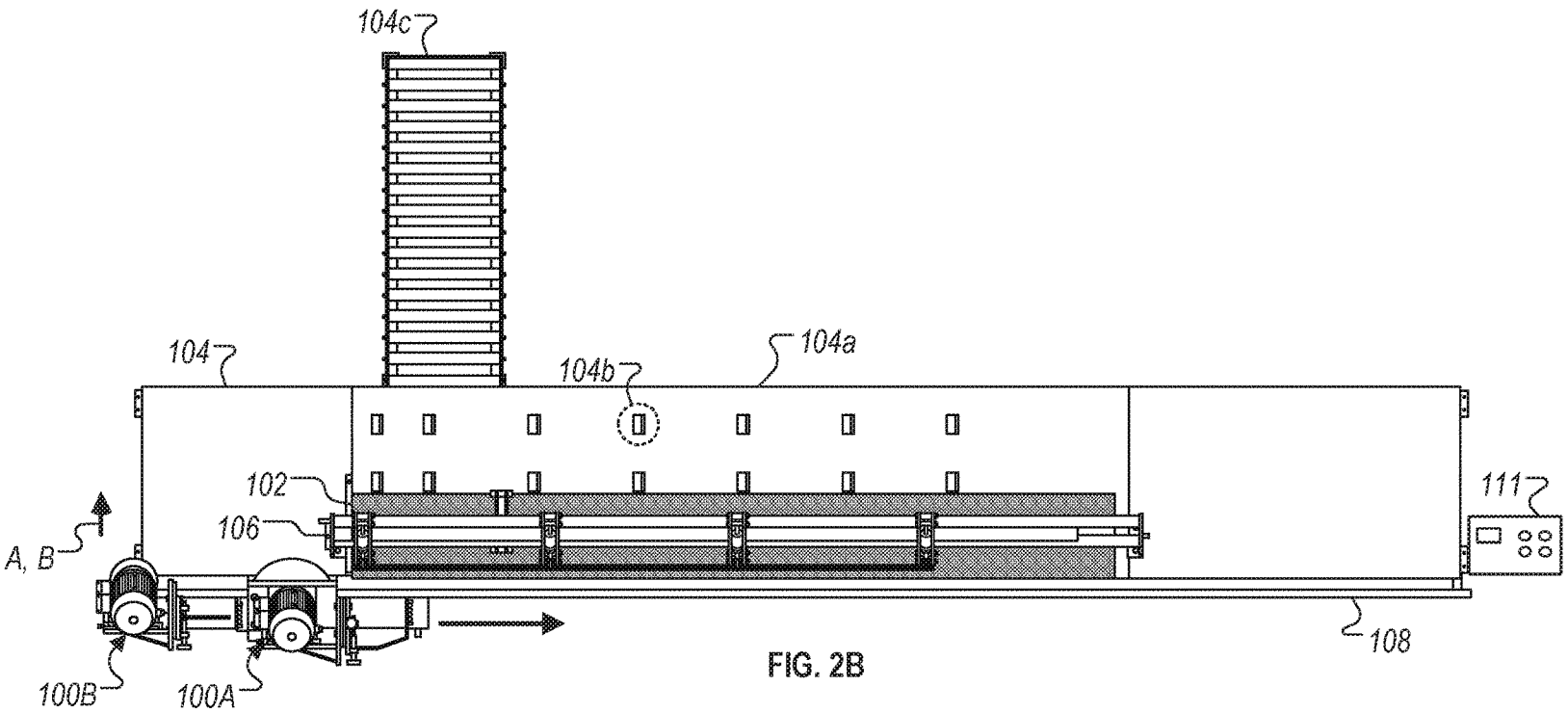
Figure 2C:
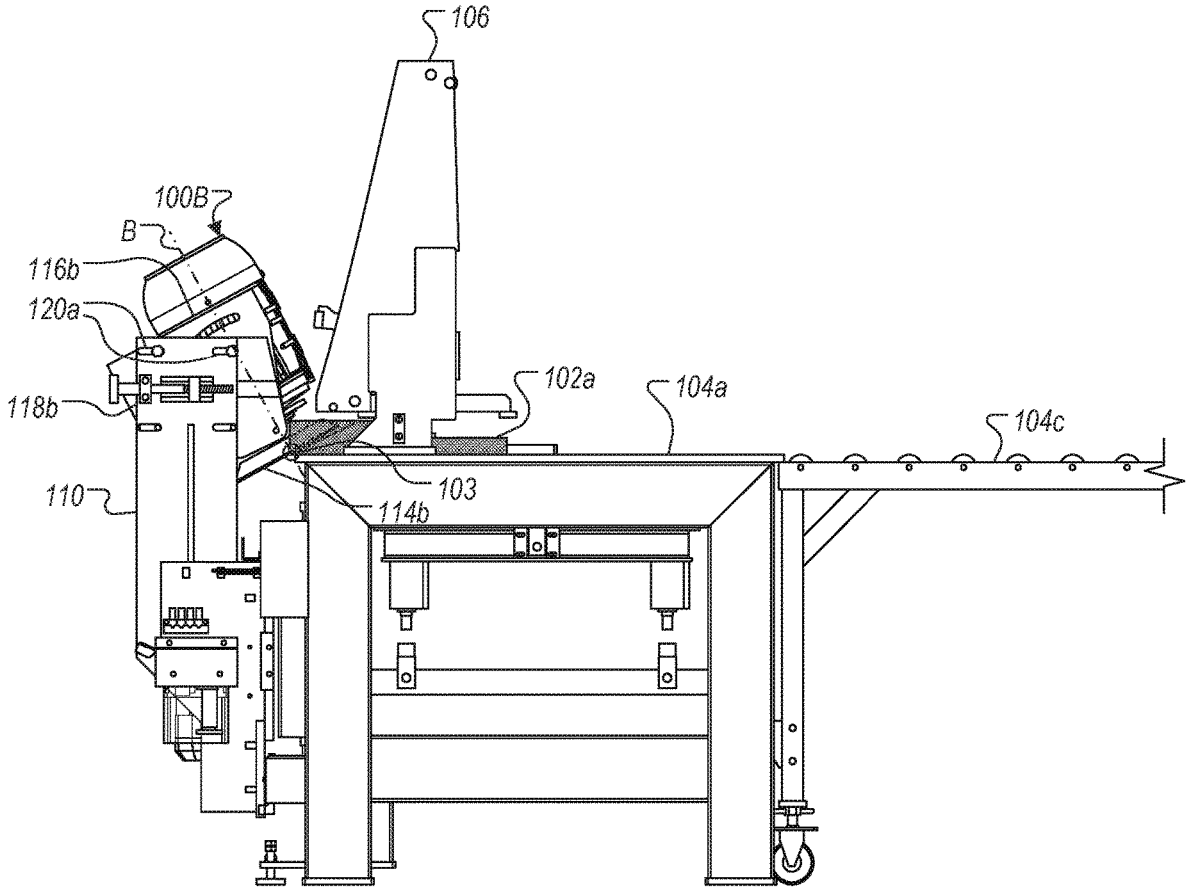

Referring to FIGS. 2A-2C, plan views of the miter saw 100 of FIG. 1A are shown. FIG. 2A illustrates a longitudinal side view of the miter saw 100 with the extension table 104*a* facing outward. FIG. 2B illustrates a top of the miter saw 100. FIG. 2C illustrates a lateral view of the miter saw 100.

In the view of FIGS. 2A and 2B, carriage 110 is shown in an initial position prior to performing a cutting operation of the slab 102. In an exemplary embodiment, the carriage 110 moves along guide rail 108 relative to the position of the slab 102 to cut the slab 102 while the slab 102 is supported on the support structure 104 (e.g. on the rubber-topped table). The carriage 110 moves from a first end region of support structure 104 to a second end region of support structure 104 while the cutting blade 114*a* rotates to cut slab 102 and the grinding blade 114*b* rotates to grind the cut edge 103 of slab 102 cut by cutting blade 114*a* (e.g. carriage 110 moves right to left along the guide rail 108 in the view of FIG. 2A, and from left to right in the view of FIG. 2B).

During the cutting operation, the carriage 110 moves along the guide rail 108 such that the cutting blade 114*a* of the cutting head 100A contacts the slab 102 before the grinding blade 114*b* of the grinding head 100B contacts the slab 102. The cutting blade 114*a* initially cuts the slab 102 to generate a cut surface that may have a rough or serrated edge, or other surface imperfections. The cut surface is subsequently finished by the grinding blade 114*b* to reduce or remove the rough or serrated edges, or other surface imperfections, resulting from the initial cutting. For example, an outer-most edge 103 (FIG. 2C) of the cut surface of the slab (e.g., the lower edge of the slab 102 as the slab is supported by support structure 104) may be finished by the grinding blade 114*b* to reduce rough or serrated portions and produce a smooth edge 103.

A smooth edge 103 having reduce roughness or serrations facilitates subsequent seaming or assembly operations of slab 102. In an exemplary embodiment, the cut surface of slab 102, including edge 103, may be mated with a complementary surface of another slab to form a miter joint. A smooth edge 103 produce by the grinding blade 114*b* thus promotes a clean joint with a reduced visible seam and/or reduced visible adhesive used to bond slab 102 with the complementary slab.

Referring to FIG. 2C, a lateral view of the miter saw 100 is shown. The cutting head 100A, positioned in front of the grinding head 100B, is omitted from the view of FIG. 2C to illustrate a lateral view of the grinding head 100B. The miter saw 100 includes a tilt plate 116*b*, a horizontal slide plate 118*b*, and a grinding blade 114*b*.

The tilt plate 116*b* enables the position and orientation of the grinding blade 114*b* to be adjusted relative to the support plane 101 of the support structure 104. In some exemplary embodiments, the tilt plate 116*b* can be adjusted in order to enable the grinding blade 114*b*, and the grinding blade axis of rotation (B), to be rotated relative to the support plane 101. For example, the tilt plate 116*b* may be adjusted such that the grinding blade 114*b* forms an angle between 15° and 60° with the support plane 101. In various exemplary embodiments, the tilt plate 116*b* may be adjustable between 0° and 180°, 15° and 150°, 30° and 75°, and/or 22.5° and 60°, to position and orient the grinding blade 114*b* relative to the support plane 101 to grind a miter cut at a desired angle. For example, the grinding blade 114*b* may be positioned to form an angle with the support plane 101 of about 15°, 22.5°, 30°, 45°, 60°, 75° or other angle to produce a smooth cut having a desired angle for mating with a complementary slab. In an exemplary embodiment, the tilt plate 116*b* allows manual adjustment between a cutting position (e.g. in which the cutting blade 114*a* is positioned at a 45° angle relative to the support plane 101), and a maintenance position in which a larger angle is provided to allow access to grinding blade 114*b* for replacement, repair, etc. In other exemplary embodiments, control of tilt plate 116*b* may be automated such that the orientation of grinding blade 114*b* may be moved by an actuator, such as a pneumatic, hydraulic, electric, or other actuator.

The horizontal slide plate 118*b* enables the grinding blade 114*b* to be moved closer to or farther away from the slab 102 and/or support structure 104. For example, the horizontal slide plate 118*b* enables the adjustment of the grinding head 100B along a path defined by the in-out slides 120*a* (e.g. from left to right as viewed in FIG. 2C). In some embodiments, the position of the grinding head 100B can be manually adjusted by turning a screw that adjusts the position of the grinding head 100B along the in-out slides. Alternatively or additionally, the position of the grinding head 100B may be controlled by a controller 111 of miter saw 100. For example, the controller 111 can control the positioning of the grinding head 100B relative to the support plane 101 by automatically adjusting the horizontal slide plate 118*b* and/or the angle of orientation of the grinding blade 114*b* based on input received by an operator.

Figure 3A:
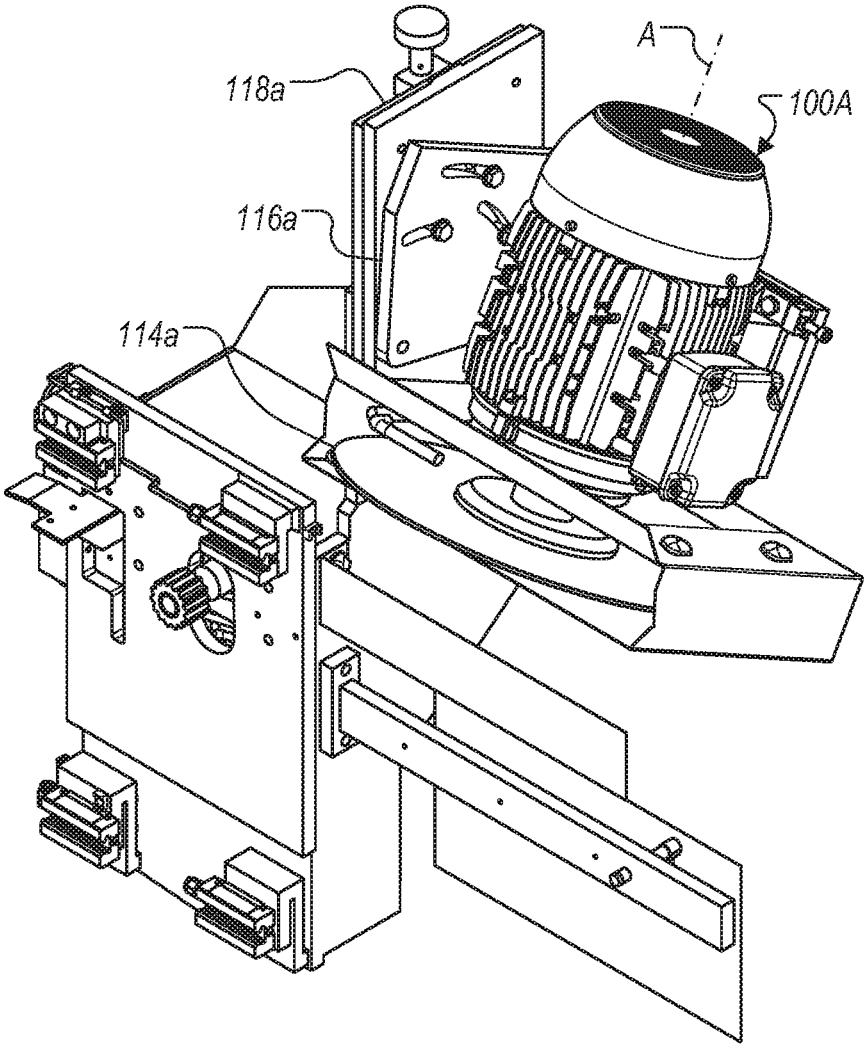
FIG. 3A is a perspective view of the cutting head of the miter saw illustrated in FIG. 1A.
Figure 3C:
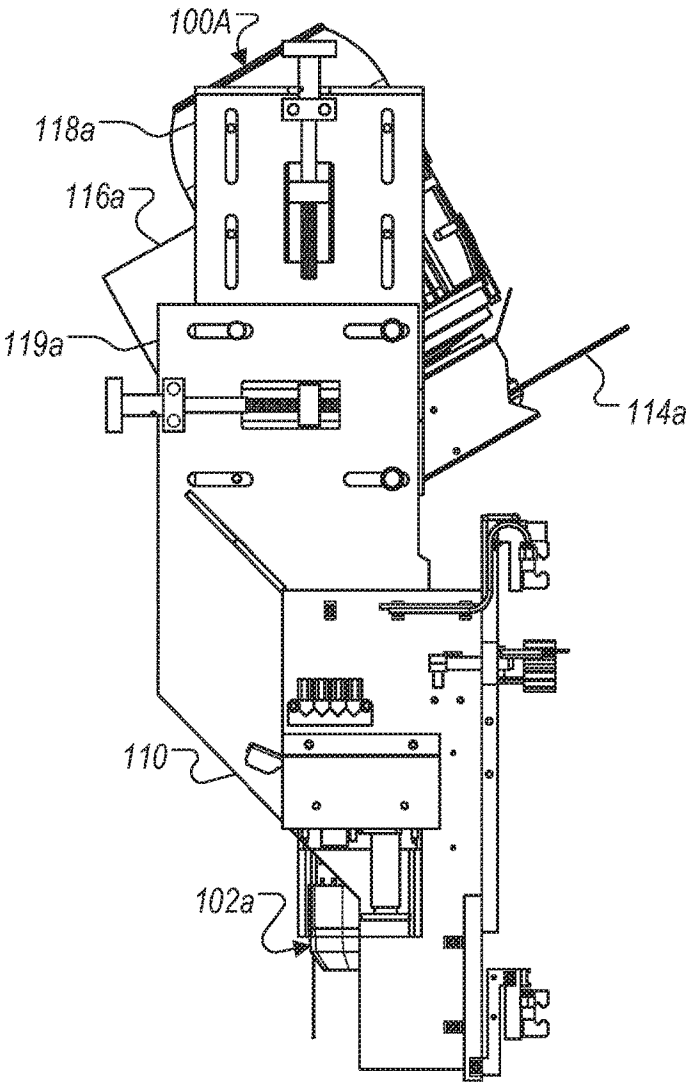
FIGS. 3B and 3C are side views of the cutting head illustrated in FIG. 3A.
Figure 3B:
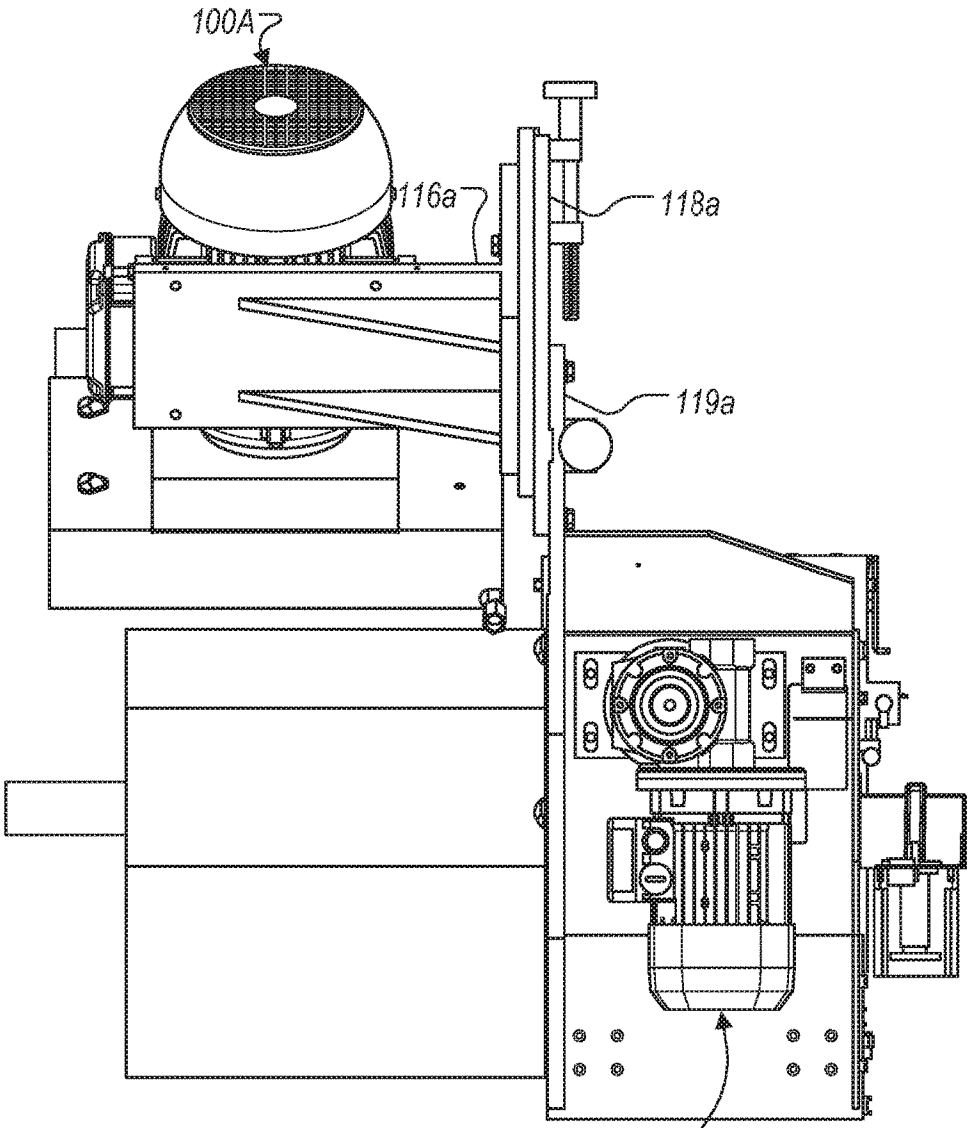

Referring to FIG. 3A, a perspective view of the cutting head 100A of the miter saw 100 of FIG. 1A, is shown. In an exemplary embodiment, the miter saw 100 includes a tilt plate 116*a*, a vertical slide plate 118*a*, a horizontal slide plate, and a cutting blade 114*a*. The grinding head 100B is omitted from the view of FIG. 3A.

The tilt plate 116*a* enables the position of the cutting blade 114*a* to be adjusted relative to the support plane 101 of the support structure 104, in a similar manner as described above with respect to the tilt plate 116*b*, for example. For example, the tilt plate 116*a* can be adjusted in order to enable a desired orientation of the cutting blade 114*a*, and the cutting blade axis of rotation (A), relative to the support plane 101. For example, the tilt plate 116*a* may be adjusted such that the cutting blade 114*a* forms an angle between 45° and 60° with the support plane 101. In various exemplary embodiments, the tilt plate 116*a* may be adjustable between 0° and 180°, 15° and 150°, 30° and 75°, and/or 22.5° and 60°, to position and orient the cutting blade 114*a* relative to the support plane 101 to produce a miter cut at a desired angle. For example, the grinding blade 114*b* may be positioned to form an angle with the support plane 101 of about 15°, 22.5°, 30°, 45°, 60°, 75° or other angle to produce a smooth cut having a desired angle for mating with a complementary slab. In an exemplary embodiment, the tilt plate 116*a* allows manual adjustment between a cutting position (e.g. in which the cutting blade 114*a* is positioned at a 45° angle relative to the support plane 101), and a maintenance position in which a larger angle is provided to allow access to cutting blade 114*a* for replacement, repair, etc. In other exemplary embodiments, control of tilt plate 116*a* may be automated such that the orientation of cutting blade 114*a* may be moved by an actuator, such as a pneumatic, hydraulic, electric, or other actuator.

The horizontal slide plate 118*b* allows the cutting blade 114*a* to be moved closer to or farther away from the slab 102 and/or support structure 104. For example, the horizontal slide plate 118*a* allows the cutting blade 114*a* to be moved in a manner similar to that of the horizontal slide plate 118*b* as described above. Alternatively, or additionally, the position of the cutting head 100A may be controlled by a controller 111 of saw 100. For example, the controller 111 can control the positioning of the cutting head 100A relative to the support plane 101 by automatically adjusting the vertical and horizontal slide plates 118*a* and 118*b* and/or the angle of orientation of the cutting blade 114*a* based on input received by an operator.

In some embodiments, the tilt plate 116*a* and the tilt plate 116*b* are independently adjustable relative to one another such that the cutting head 100A and the grinding head 100B can be positioned at different angles relative to the support plane 101 described above. The cutting blade 114*a* can be used to perform a miter cut at a specified angle on the slab 102, while the grinding blade 114*b* can be used to finish an edge of the miter cut. For example, after the cutting blade 114*a* cuts through the slab 102 to produce the edge 103, the grinding blade 114*b* can grind the cut surface, including edge 103, to form a consistent, finished edge with reduced roughness and/or serrations. In some exemplary embodiments, the grinding blade 114*b* can be used to form the edge 103 with a desired edge finish (e.g. having a desired smoothness and/or sharpness).

In some embodiments, the cutting blade 114*a* and the grinding blade 114*b* are configured to rotate at identical speeds (e.g., with identical rotations per minute). The grinding blade 114*b* can be used to polish, clean, remove excess material, or otherwise finish the cut edge 103 of slab 102 that is cut by the cutting blade 114*a*. In an exemplary embodiment, the cutting blade 114*a* and the grinding blade 114*b* advance at the same speed along slab 102 while rotating at identical speeds and separated by a fixed distance relative to each other. Such an operation of the miter saw 100 can provide a smooth cut edge 103 of slab 102 in an efficient manner with a single pass of cutting blade 114*a* and grinding blade 114*b* along slab 102.

Referring now to FIG. 4A, a cutting blade 414*a* with a radial cutting surface 402*a* is illustrated, and in some embodiments includes characteristics similar to cutting blade 114*a* described herein. Radial cutting surface 402*a* includes at least a portion of the outer perimeter of cutting blade 414*a* that defines a thickness of cutting blade 414*a*. The radially cutting surface 402*a* extends radially relative to the cutting blade axis of rotation (A) (e.g. perpendicular to the axis of rotation (A)). The cutting blade 414*a* includes characteristics that facilitate cutting ability and robustness, such as a coating of diamond particles on the cutting surface 402*a*. Alternatively or additionally, the cutting blade 414*a* can have a segmented edge such that the perimeter of cutting blade 414*a* includes a plurality of segments 404*a* separated by gaps. In other exemplary embodiments, cutting blade 414*a* may include various blade teeth patterns (e.g., cross-cut, rip cut, plytooth, etc.) selected to cut a particular material type.

Figure 4B:
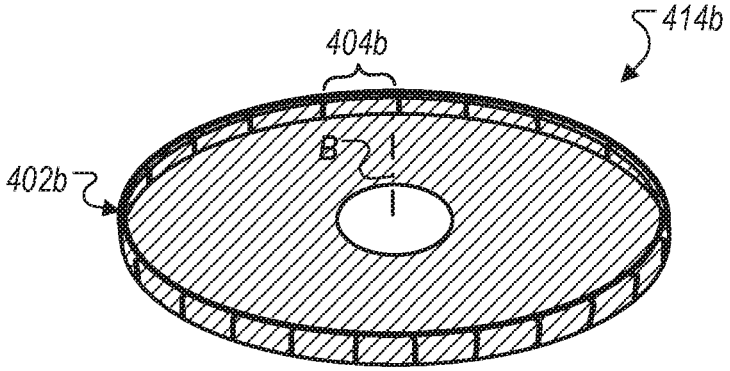
FIG. 4B is a perspective view of an exemplary grinding blade.

Referring to FIG. 4B, a grinding blade 414*b* having a grinding surface 402*b* is illustrated. In some exemplary embodiments, the grinding surface 402*b* extends axially relative to the grinding blade axis of rotation (B) (e.g. parallel with the grinding blade axis of rotation (B)). The grinding blade 414*b* includes characteristics that facilitate cutting ability and robustness, such as a coating of diamond particles on the grinding surface 402*b*. Alternatively or additionally, the grinding surface 402*b* may be smooth, segmented, or serrated based on the type of material to be polished, grinded, or otherwise finished using the grinding blade 414*b*. In an exemplary embodiment, the grinding blade 414*b* can have a segmented edge such that the perimeter of the grinding blade 114*b* includes a plurality of segments 404*b* separated by gaps. Each segment 404*b* may extend substantially parallel to, or about a particular angle (e.g., 65°, 75°, 85°) with the grinding blade axis of rotation (B).

In an exemplary embodiment, the segments 404*b* of grinding blade 414*b* may be aligned with an edge of the slab (e.g. edge 103 of the slab 102) so that the axial surface of grinding surface 402*b* contacts the slab. Alternatively or in addition, radial portions of grinding surface 402*b* may contact the slab. In other exemplary embodiments, the grinding blade axis of rotation may be aligned with an edge of the slab (e.g. edge 103 of slab 102) so that axial and/or radial surfaces of grinding surface 402*b* contact the slab.

Figure 4C:
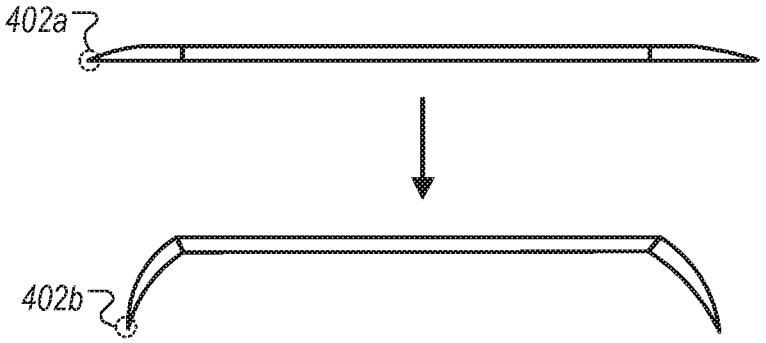
FIG. 4C is a perspective view illustrating an exemplary technique for forming the exemplary grinding blade shown in FIG. 4B.

Referring now to FIG. 4C, a process for generating the axial grinding surface 402*b* of FIG. 4B is illustrated. An edge of a blade (e.g. such as a blade having characteristics identical to cutting blade 414*a*) may be bent towards the axis of rotation. For example, each segment 404*a* is bent 90° relative to a major face of the blade. Miter saw 100 may thus be operated using a cutting blade and grinding blade made from the same material, while the cutting blade has a radial cutting surface and the grinding blade has bent segments that provide an axial grinding surface. In some exemplary embodiments, the cutting blade 414*a* may be a commercially available cutting blade. Alternatively or additionally, grinding blade 414*b* may be a commercially available cutting blade (e.g. of the same type as cutting blade 414*a*) and/or having segments 404*b* bent relative to a major face of the blade.

Figure 5:
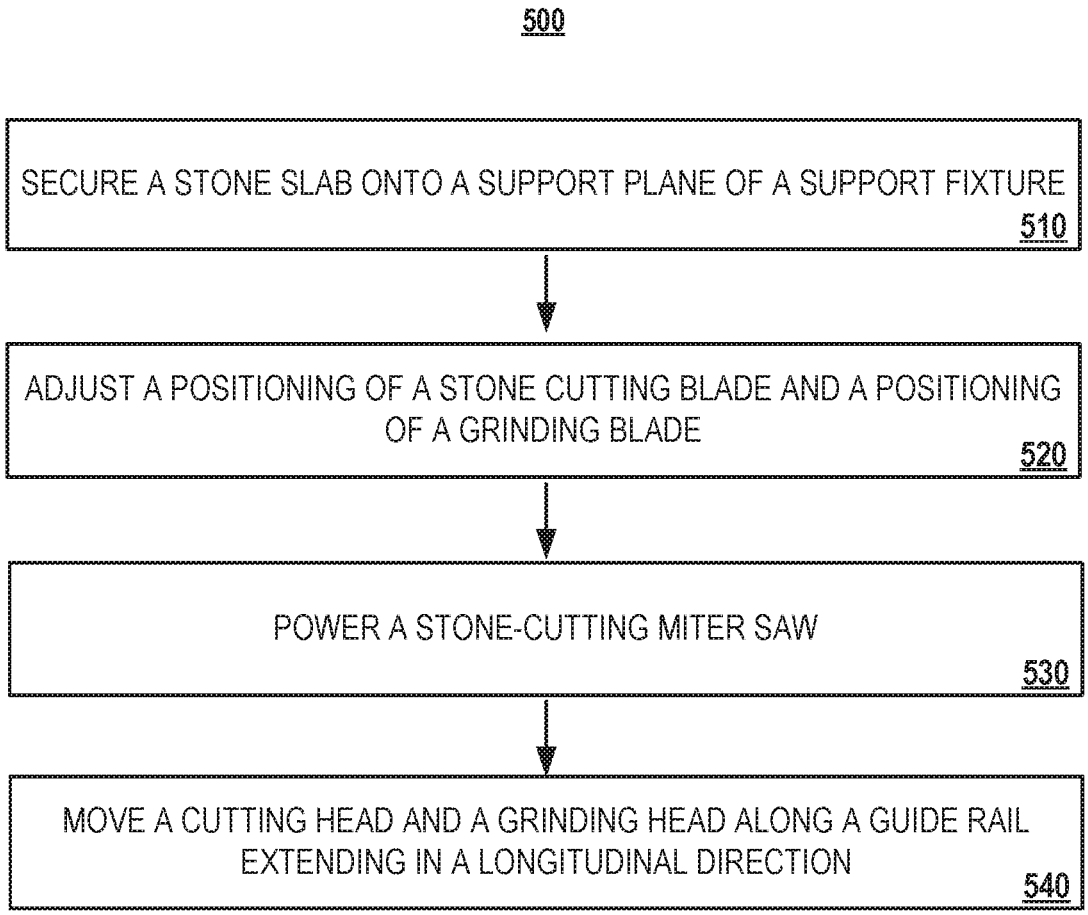
FIG. 5 is a flow diagram of an exemplary process of cutting a stone slab.

Referring now to FIG. 5, a flow diagram of an exemplary process 500 of cutting a stone slab is shown. In an exemplary embodiment, the process 500 can include securing a stone slab onto a support plane of a support fixture and moving a cutting head and a grinding head along the stone slab to cut and finish the stone slab.

In an exemplary embodiment, the process 500 includes operation 510 of securing a stone slab onto a support plane of a support fixture. Operation 510 may include positioning the stone slab (e.g. such as slab 102 described herein) onto a table of the support fixture. Once loaded, the positioning of the stone slab can be adjusted to align an edge of the stone slab to be cut with a guide rail that guides the cutting head and grinding head along the stone slab (e.g. such as guide rail 108 shown in FIG. 1A). In some exemplary embodiments, operation 510 may further include fixing the position of the stone slab by one or more clamping structures. For example, once a desired positioning of the slab 102 is achieved on top of the table, the positioning of the stone slab can be secured by lowering pneumatic clamps onto the top surface 102*a* of the slab 102.

In an exemplary embodiment, the process 500 can include operation 520 of adjusting a positioning of a stone cutting blade (e.g., the cutting blade 114*a*) and a positioning of a grinding blade (e.g. the grinding blade 114*b*). The configuration of tilt plates (e.g. such as tilt plates 116*a* and 116*b* described herein) can be adjusted in order to enable the cutting blade 114*a* and the grinding blade 114*b*, respectively, to be rotatable relative to the support plane of the support fixture 104 at a desired position and orientation. For example, operation 520 may include adjusting a tilt plate (e.g. such as tilt plates 116*a* and 116*b* described herein) such that the cutting blade and/or grinding blade forms a desired angle with the surface of the slab to be cut. Similarly, operation 520 may include adjusting the configuration of one or more slide plates (e.g. such as horizontal and vertical slide plates 118*a* and 118*b* described herein) to move the cutting blade and/or grinding blade horizontally and vertically.

Operation 520 may be performed before or after operation 510 of securing the stone slab. For example, the miter saw may be configured such that the cutting and grinding blades are in a desired position before a stone slab is secured for cutting.

The exemplary process 500 may include operation 530 of powering a stone-cutting miter saw. For instance, in various exemplary embodiments, the saw 100 can be powered to enable the cutting blade 114*a* and the grinding blade 114*b* to rotate at a desired RPM that facilitates efficient and consistent cutting and grinding (e.g. grinding, polishing, finishing, etc.). The cutting blade 114*a* and the grinding blade 114*b* can be driven using motors, such as electric motors. In an exemplary embodiment, operation 530 includes powering the cutting blade 114*a* and the grinding blade 114*b* to rotate at identical RPMs.

The exemplary process 500 may include operation 540 of moving the cutting blade and grinding blade along the slab. For example, operation 540 includes moving the cutting head and the grinding head in the longitudinal direction along a guide rail while the cutting and grinding heads are powered to cut and finish the stone slab. Moving the cutting blade along the stone slab produces a cut, such as a miter cut, through a thickness of the stone slab. Moving the grinding blade along the stone slab grinds or otherwise finishes the cut produced by the cutting blade to produce a clean edge having reduce roughness and/or serration.

In some exemplary embodiments, operation 540 includes moving the cutting head 100A and the grinding head 100B on a carriage such that a fixed distance between the cutting head and the grinding head is maintained as the carriage is moved in the longitudinal direction, and/or so that both the cutting head and grinding head simultaneously operate on the same edge of the slab. Alternatively or in addition, the cutting head and the grinding head can be performed such that a single pass of cutting head and grinding head along a length of the stone slab both cuts and finishes the slab 102.

In various exemplary embodiments, process 500 may provide one or more advantages. Moving cutting head and grinding head along a length of the slab produces finer cuts along the surface of the slab 102. The grinding head follows the cutting head to grind, polish, and otherwise smooth the slab surface that is initially cut by the cutting head such that the finished surface may have a clean edge with reduced roughness or serrations.

In some exemplary embodiments, the process 500 enables an automated or semi-automated cutting and grinding operation. An edge and/or surface of a slab may be cut and/or finished with reduced manual intervention. The cutting head and grinding head advance in series on a common surface of the stone slab without repositioning of the slab and/or without reconfiguration of the cutting and grinding heads.

Exemplary process 500 may facilitate assembly of countertops, work surfaces, wall coverings, etc., using cut stone slabs. A stone slab having a miter edge produced by advancing a cutting head and a grinding head along a length of the stone slab may provide a smooth edge that facilitates seaming or jointing operations with other stone slabs. A smooth finished edge may facilitate a reduced visual appearance of seams or joints, and/or reduce additional processing steps during assembly and installation to produce a desired seam or joint.

While this specification contains many specific embodiment details, these should not be construed as limitations on the scope of any invention or of what may be claimed, but rather as descriptions of features that may be specific to particular embodiments. Certain features that are described in this specification in the context of separate embodiments can also be implemented in combination in a single embodiment in part or in whole. Conversely, various features that are described in the context of a single embodiment can also be implemented in multiple embodiments separately or in any subcombination. Moreover, although features may be described herein as acting in certain combinations and/or initially claimed as such, one or more features from a claimed combination can in some cases be excised separate from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Although a number of embodiments have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method for cutting and grinding a stone slab using a stone-cutting miter saw, comprising:

securing the stone slab to a support fixture;

advancing, in a single pass, a cutting blade and a grinding blade in series along a length of the stone slab while the cutting blade and grinding blade rotate to cut and grind, respectively, an edge of the stone slab;

wherein during the single pass advancing step, the cutting blade rotates about a cutting blade axis of rotation to cut the edge of the stone slab and the grinding blade rotates about a grinding blade axis of rotation to grind the cut edge of the stone slab, and the cutting blade axis of rotation is maintained in a fixed position relative to the grinding blade axis of rotation.

2. The method of claim 1, wherein during the advancing step, the cutting blade axis of rotation is parallel to the grinding blade axis of rotation.

3. The method of claim 1, wherein the cutting blade axis of rotation is positionable between about 30 to about 60 relative to a major surface of the stone slab.

4. The method of claim 1, wherein the cutting blade comprises a radial cutting surface.

5. The method of claim 4, wherein the grind blade comprises an axial grinding surface.

6. The method of claim 1, wherein the cutting head is supported on a guide rail by a first carriage and the grinding head is supported on the guide rail by a second carriage.

7. The method of claim 6, wherein advancing the cutting blade and the grinding blade in series comprises independently moving the first and second carriages on the guide rail.

8. The method of claim 1, wherein securing the stone slab to a support fixture comprises clamping the stone slab to the support fixture.

9. The method of claim 1, wherein movement of the cutting head and grinding head along the guide rail is controlled by a programmable logic controller (PLC).

10. The method of claim 1, further comprising positioning the cutting blade at a first angle relative to a major surface of the stone slab, and positioning the grinding blade at a second angle relative to the major surface of the stone slab.

11. The method of claim 10, wherein the first and second angles are identical.

12. A method for cutting and grinding a stone slab using a stone-cutting miter saw, comprising:

securing the stone slab to a support fixture;

advancing a cutting blade and a grinding blade in series along a length of the stone slab while the cutting blade and grinding blade rotate to simultaneously operate on an edge of the stone slab in a single pass, the cutting blade cutting an edge to generate a cut surface and the grinding blade grinding the cut surface during the single pass.

13. The method of claim 12, wherein during the advancing step, the cutting blade rotates about a cutting blade axis of rotation and the grinding blade rotates about a grinding blade axis of rotation, and the cutting blade axis of rotation is maintained in a fixed position relative to the grinding blade axis of rotation.

14. The method of claim 12, wherein during the advancing step, the cutting blade axis of rotation is parallel to the grinding blade axis of rotation.

15. The method of claim 12, further comprising positioning the cutting blade at a first angle relative to a major surface of the stone slab, and positioning the grinding blade at a second angle relative to the major surface of the stone slab.

16. The method of claim 15, wherein the first and second angles are identical.

17. The method of claim 12, wherein the grind blade comprises an axial grinding surface.

18. The method of claim 17, wherein the cutting blade comprises a radial cutting surface.

19. The method of claim 12, wherein the cutting head is supported on a guide rail by a first carriage and the grinding head is supported on the guide rail by a second carriage.

20. The method of claim 19, wherein advancing the cutting blade and the grinding blade in series comprises independently moving the first and second carriages on the guide rail.

* * * * *